US005644890A

United States Patent [19]

Koo

[11] Patent Number: 5,644,890

[45] Date of Patent: Jul. 8, 1997

[54] METHOD TO CONSTRUCT THE PRESTRESSED COMPOSITE BEAM STRUCTURE AND THE PRESTRESSED COMPOSITE BEAM FOR A CONTINUOUS BEAM THEREOF

[75] Inventor: Min-Se Koo, Inchoen, Rep. of Korea

[73] Assignees: Dae Nung Industrial Co., Ltd., Chungcheongnam-Do; Dae Nung Construction Co., Ltd., Kyeongsangnam-Do, both of Rep. of Korea

[21] Appl. No.: 343,562

[22] PCT Filed: Mar. 23, 1994

[86] PCT No.: PCT/KR94/00025

§ 371 Date: Nov. 22, 1994

§ 102(e) Date: Nov. 22, 1994

[87] PCT Pub. No.: WO94/23147

PCT Pub. Date: Oct. 13, 1994

[30] Foreign Application Priority Data

| | | | |
|---|---|---|---|
| Apr. 1, 1993 | [KR] | Rep. of Korea | 5489/1993 |
| May 21, 1993 | [KR] | Rep. of Korea | 8710/1993 |
| Jul. 15, 1993 | [KR] | Rep. of Korea | 13278/1993 |

[51] Int. Cl.[6] ..... E04B 1/00

[52] U.S. Cl. ..... 52/742.14; 52/223.1; 52/745.19

[58] Field of Search ..... 52/223.1, 223.7, 52/720.1, 742.14, 745.19; 14/73, 74.5

[56] References Cited

U.S. PATENT DOCUMENTS

| | | | |
|---|---|---|---|
| 2,917,901 | 12/1959 | Lackner | 52/223.1 X |
| 4,343,123 | 8/1982 | Soerjohadikusumo | 52/225 |
| 4,503,652 | 3/1985 | Turner | 52/657 |
| 4,525,965 | 7/1985 | Woelfel | 52/309.17 |
| 4,571,913 | 2/1986 | Schleich et al. | 52/722 |
| 4,584,811 | 4/1986 | Balinski | 52/714 |
| 4,586,303 | 5/1986 | Jartoux et al. | 52/309.16 |
| 4,646,493 | 3/1987 | Grossman | 52/223.1 |
| 4,700,516 | 10/1987 | Grossman | 52/223.1 |
| 4,712,735 | 12/1987 | Jantzen | 52/223.1 X |
| 4,745,718 | 5/1988 | O'Sullivan et al. | 52/223 R |
| 4,856,254 | 8/1989 | Jungwirth | 52/223.1 X |

FOREIGN PATENT DOCUMENTS

| | | |
|---|---|---|
| 336234 | 4/1977 | Austria . |
| 123642 | 10/1984 | European Pat. Off. . |

*Primary Examiner*—Carl D. Friedman
*Assistant Examiner*—Beth Aubrey
*Attorney, Agent, or Firm*—Senniger, Powers, Leavitt & Roedel

[57] ABSTRACT

A method for connecting prestressed beams having lower flanges cast with compressively prestressed concrete to construct a prestressed continuous beam having a moment equal to zero at both ends thereof and negative moments at at least one connection point of the prestressed beams. The method includes the step of placing the prestressed beams in end to end relation. Adjacent ends of the prestressed beams define at least one connection point. The method further includes connecting the prestressed beams together at the connection point, deflecting the prestressed beams at at least one connection point within the limitation of elasticity of the prestressed beams to a deflected position, casting and curing concrete on the prestressed beams at the connection point, and at least partially returning the prestressed beams at the connection point from the deflected position whereby compressive stress is introduced to the concrete cast and cured on the prestressed beams at the connection point.

16 Claims, 16 Drawing Sheets

METHOD TO CONSTRUCT THE PRESTRESSED COMPOSITE BEAM STRUCTURE AND THE PRESTRESSED COMPOSITE BEAM FOR A CONTINUOUS BEAM THEREOF

BACKGROUND OF THE INVENTION

1. Technical Field

The present invention relates to a prestressed beam structure and the construction methods thereof in which expansion joints, which have been necessary in conventional prestressed beam structures, can be removed. Elimination of expansion joints prevents structural and functional problems associated with expansion joints, allows the span of beams to be lengthened, and reduces the amount of construction material required. The invention provides a construction method for continuously connecting one or more inner span beams with two outer span beams.

The present invention also relates to a construction method in which the prestressed beams can be made into a few short beam segments when transporting and handling long prestressed beams is difficult.

According to one aspect of the invention the prestressed beams are prefabricated and installed while the slabs are made of cast-in place concrete. According to another aspect of the invention, both the beams and the slabs are prefabricated and installed. According to another aspect of the invention, the concrete is prestressed by covering the steel beams. The invention provides an economical prestressed beam structure of high quality in a short construction period while conserving materials by utilizing the material properties of concrete and steel.

2. Background Art

Typical simple beam type prestressed beams are disclosed in Korean Patent Publication No. 88-1163 (Jul. 2, 1988) and Korean Patent Laid-open No. 92-12687 (Jul. 27, 1992) entitled "PRESTRESSED COMPOSITE BEAMS AND THE MANUFACTURING METHOD THEREOF", which provide a simple type prestressed beam, in which the cambered I-beam is first prestressed by preloading, concrete is cast on the lower flange of said prestressed I-beam, and then the preloads are removed after the concrete has cured (FIG. 4). The conventional prestressed beam of the above type is advantageous with respect to rapid construction, reduced beam depth, material conservation and improved fatigue failure strength. But, if the building is long these simple type prestressed beams must be joined to span long distances. In general, the beams in the span are connected with expansion joints.

In the case of prestressed beam bridges, the necessary expansion joints are expensive, impact driving comfort, and require maintenance. In addition, the impact of vehicles driving on the expansion joint and subsequent leakage of water on the expansion joints increases the deterioration of the bridges. The conventional prestressed beam bridges have had to use the expansion joints in spite of the above problems, because the solution to the negative moments acting on the inner supports caused by dead and live loads could not be found. In the case of prestressed beam buildings, expansion joints weaken resistance to earthquakes.

In the continuous beam structure of the present invention, however, contrary to the conventional prestressed beam structure in which expansion joints are provided in the beam joint portions, tensile stress will occur on the upper flange of the inner supports due to the negative moments caused by dead and live loads. The introduction of prestressed compressive stress against corresponding tensile stress is not considered in the conventional prestressed beam method (refer to FIG. 11).

SUMMARY OF THE INVENTION

One object of the invention is to provide a construction method for joining short span prestressed beams without employing expansion joints such that the problems associated with expansion joints of the conventional prestressed beam structure can be eliminated, fatigue failure strength or earthquake resistance can be enhanced, and deflection can be reduced.

Another object of the invention is to provide a construction method for joining the prestressed beams to form a prestressed continuous beam such that the maximum bending moment on an inner span of the prestressed continuous beam due to dead and live loads can be considerably reduced from that of conventional simple beam type prestressed beams, to achieve a light weight, long span slender beam structure with a straight or curved beam axis.

According to the invention, in the case of the two span continuous beam, the maximum bending moment is reduced by 44% under uniformly distributed loads, and is reduced by 23% under concentrated loads when compared to the conventional simple beam type prestressed beam structure. In the case of the three span continuous beam, the maximum bending moment on the midpoint of the inner beam is reduced by ⅕ under uniformly distributed loads, and is reduced by 25% under concentrated loads was compared to the conventional simple beam type structure. As for the four or more span continuous beam, the maximum bending moment is reduced similarly.

Therefore, by unifying the prestressed beams of the two span structure, compared with the conventional simple beam type structure significant material reduction can be achieved or the length of one span can be lengthened by 20 to 30%. In the case of the three or more span structure, the outer span can be lengthened by amounts similar to those of the two span structure, and the inner span can be lengthened by 25% more than that of the outer span (refer to FIG. 8).

In the case of an architectural building, reduction of beam depth will result in higher floor height in addition to the above mentioned advantages, so that larger inner space can be obtained.

A computer simulation was conducted using a general purpose finite element method software package program on a model of the two span prestressed continuous beam structure. The detailed data has been omitted in this specification, but the results of the beam deflection are shown in the attached drawings. The detailed processes for constructing the prestressed continuous beam structure according to the invention will be described with reference to the drawings.

Generally, a method of the present invention for connecting prestressed beams includes the step of placing the prestressed beams in end to end relation thereby forming a row of prestressed beams including a first end prestressed beam at one end of the row and a second end prestressed beam at an opposite end of the row. The first and second end prestressed beam each have another end which is not adjacent to an end of any other prestressed beam in the row. Adjacent ends of the prestressed beams in the row define at least one connection point. The method further includes connecting the prestressed beams together at the connection point, and deflecting the prestressed beams at at least one connection point within the limitation of elasticity of the prestressed beams to a deflected position. Concrete is cast and cured on the prestressed beams at the connection point, and the prestressed beams at the connection point are at least partially returned from said deflected position whereby compressive stress is introduced to the concrete cast and cured on the prestressed beams at the connection point.

DETAILED DESCRIPTION OF THE PREFERRED EMBODIMENT

A method of this invention is for connecting prestressed beams having lower flanges cast with compressively prestressed concrete to construct a prestressed continuous beam. The prestressed continuous beam has a moment equal to zero at both ends thereof and negative moments at connection points of the prestressed beams. The prestressed continuous beam is made up of a first end prestressed beam at one end of the continuous beam and a second end prestressed beam at an opposite end of the continuous beam. The end prestressed beams are also referred to herein as outer prestressed beams. If the continuous prestressed beam is made up of more than two prestressed beams, at least one inner prestressed beam will be included in between the two end prestressed beams.

Figure 1A:
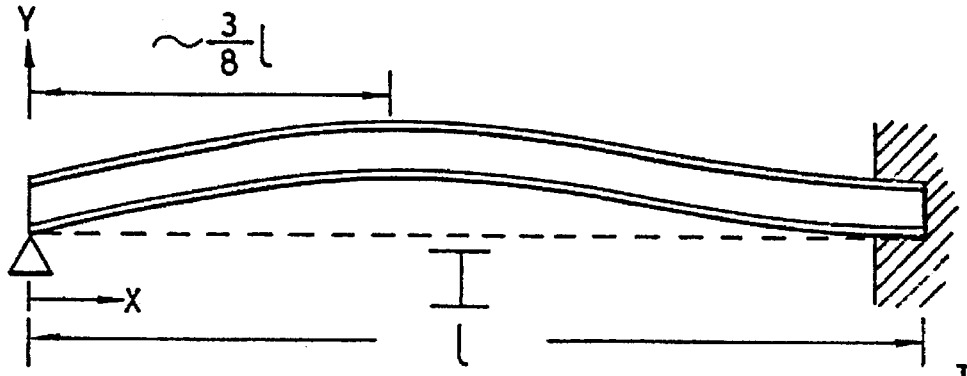
FIGS. 1A, 1B, and 1D show a process for constructing an outer prestressed beam for connection with a slab made of cast-in place concrete according to the present invention.

FIGS. 1A to 1D show a method for constructing an outer prestressed beam of a prestressed continuous beam. The outer beam has a length l. FIG. 1A shows an upwardly bent steel I-beam and supports for the beam. The first support is a roller support and the second support is a fixed support. The I-beam is formed having a bending curve which is a parabolic curve having a peak at a distance of ⅜ l from the left end of the outer beam in which the maximum bending moment occurs under uniformly distributed loads and the expression is determined as below.

$x \leqq 0.3\,l$:

$$y(x) = \frac{\sigma_{all} \bullet \omega}{EIl}\,(-0.581x^3 + 0.228xl^2)$$

$x \geqq 0.3\,l$:

$$y(x) = \frac{\sigma_{all} \bullet \omega}{EIl}\,(0.454x^3 - 0.936lx^2 + 0.51l^2x - 0.028l^3)$$

where x: arbitrary distance from the left end of the steel I- beam.

y: upward displacement of any point x from the left end of the steel I-beam.

l: length of the outer beam steel I-beam of the prestressed continuous beam structure.

$\sigma_{all}$: allowable stress of the steel beam which is about 80 to 90% of yield stress $\sigma_\gamma$ E: elastic coefficient of 21,000 KN/cm$^3$ I: moment of inertia of cross section for steel I-beam ω: modulus of section for steel I-beam The above parabolic formula as applied to the I-beam is used to provide a peak at a distance of ⅜ l from the left end of the beam. The parabolic formula may be changed a little according to the dead load, live load or the number of beams.

On both sides of the outer beam, preflexion loads are positioned at a distance of ⅛ l from the maximum bending moment point of ⅜ l in the outer beam. The moment of the outer beam is influenced more by dead loads than live loads in the case of a continuous beam structure with a beam of 20 meters or more. The right end of the steel I-beam is preferably fixed to a sufficient margin (refer to FIG. 4) so that it retains a configuration which is easily connected with a second beam, and, if necessary, so that the end may be reinforced with stiffener.

Another reason why the right end should be fixed and not hinged like the conventional simple type prestressed beam is to minimize the curvature which counteracts against the negative moment caused by dead and live loads in the inner support when two prestressed beams are continuously unified. If the fixed end is to function as a mechanically substantial fixed end when the preflexion loads are applied, the right end of the steel I-beam should be fixed to the second steel I-beam with bolts which are easily fastened and released, and, where necessary, the left end of the second steel I-beam should be fixed at proper intervals.

In the case where the right end is not treated as a fixed end, a hinged support should be installed at the point where the positive moment intersects with the negative moment under dead loads in the outer beam of the continuous beam structure, that is, at a distance of 0.75 l from the left end, and prestressed compression should be introduced only on the lower flange of the steel I-beam.

Figure 1B:
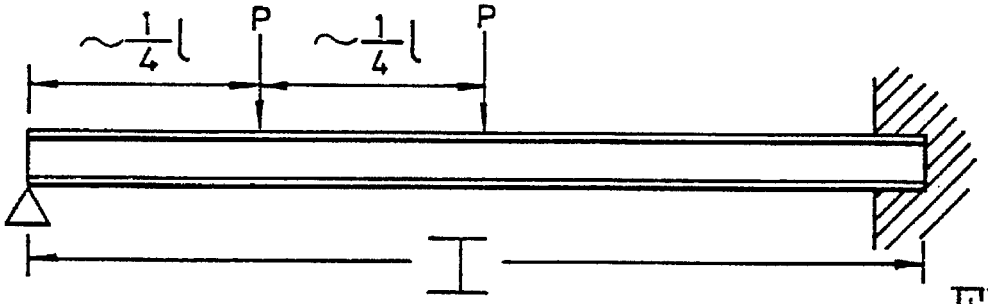
Figure 1C:
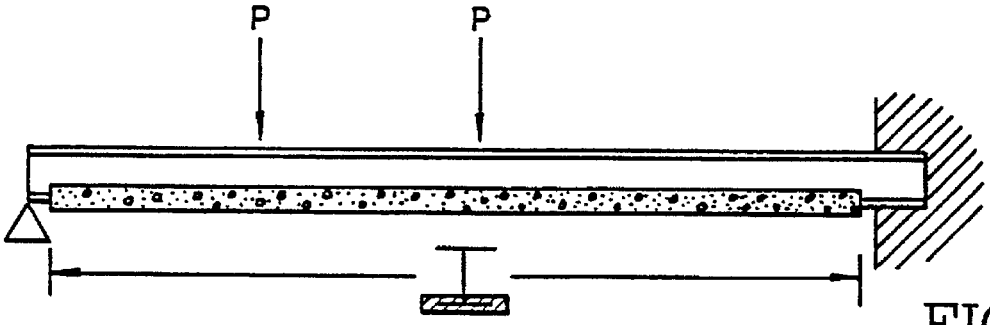

FIG. 1B shows preflexion loads applied to bent steel I-beams within elastic limitation, and FIG. 1C shows concrete cast on the lower flange of the steel I-beam under preflexion loads in order to introduce prestressed compressive stress or tensile strain. During this process, concrete may only be cast on the positive moment area. Concrete may be cast on the negative area after the preflexion loads have been removed. The position of the preflexion loads should be such that the center of the two preflexion loads are located at a distance of ⅜ l from the left end of the steel I-beam on which the maximum bending moment by dead loads is acting in the outer beam of the continuous beam structure. In addition, the two preflexion loads should be ⅛ l away from the center of the two loads. The preloading method may be similar to that of the conventional prestressed beam structure (refer to FIGS. 11A to 11D).

Figure 1D:
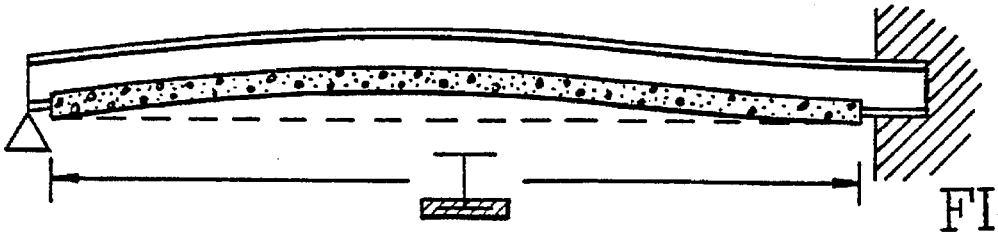

When the preflexion loads are removed, compressive stress is introduced to the positive moment area of cast concrete on the lower flange of the steel I-beam, and tensile strain may be introduced to the negative moment area of the same, such that a prestressed beam for the outer beam of a continuous beam structure can be achieved. As shown in FIG. 1D, the curvature of the beam ¼ l from the right end in which negative moments are produced by dead loads is gradual and smooth.

Another advantage of the continuous prestressed beam according to the invention is that the beam can be manufactured in divided segments. This can be achieved by making a division at a point where the bending moment and the negative moment intersect each other when the beam is unified. This solves the problem of transporting and handling long beams. This also makes it possible to elongate beam length to more than 50 meters, the maximum length of one simple beam, without reducing the structural safety.

Figure 2A:
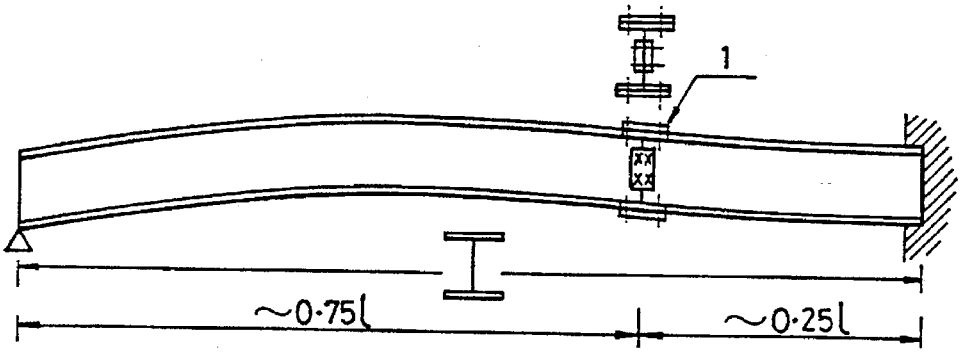
FIGS. 2A, 2B, 2C and 2D show a process for constructing segments of an outer span beam for connection with a slab made of cast-in place concrete according to the present invention.
Figure 15:
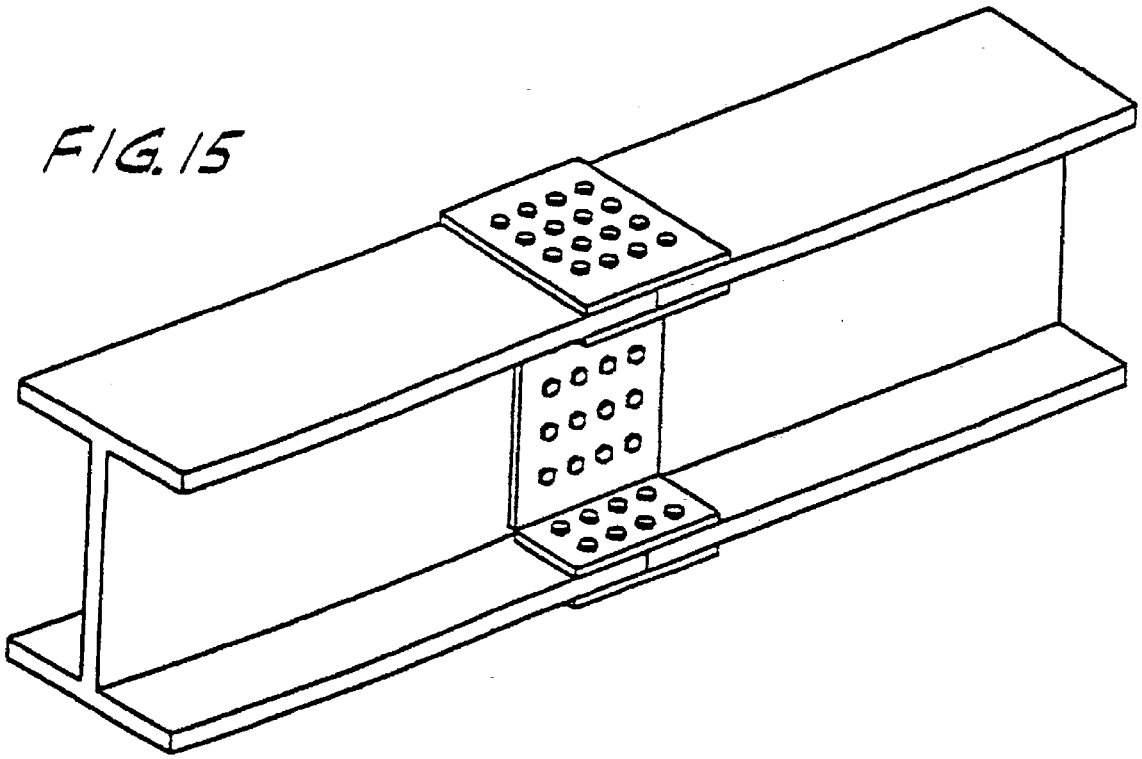
FIG. 15 shows a connector for connecting two prestressed beams as shown in FIGS. 2A–2C.

FIG. 2A shows the outer beam of a continuous beam structure having a connection 1 at a distance of 0.75 l from the left end in which the moment is approximately zero. The connection 1 is preferably a bolt and nut type connection which can be easily fastened and released. A typical bolt and nut type connector is shown in FIG. 15.

Figure 2B:
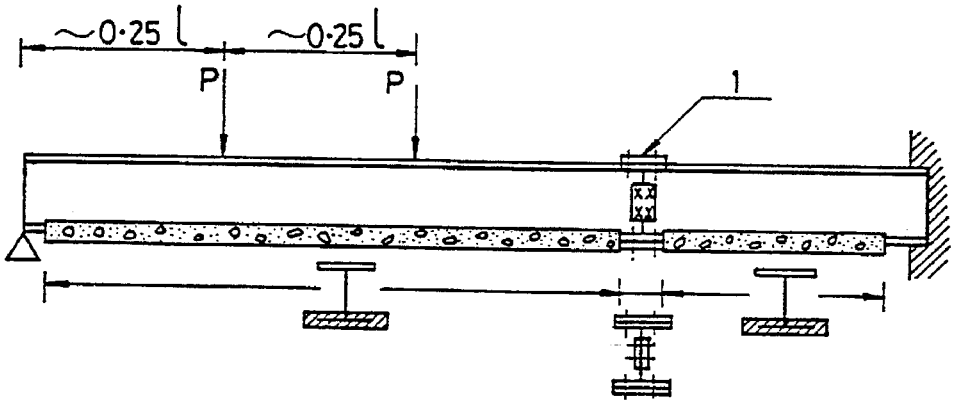
Figure 2C:
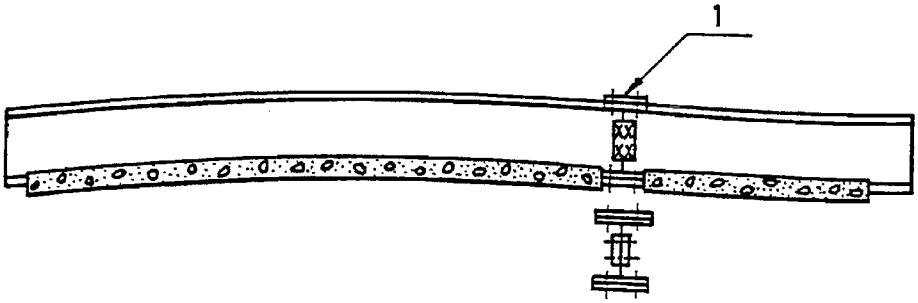
Figure 2D:
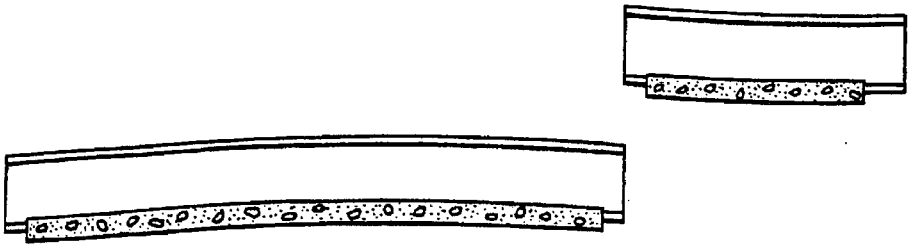

The steps shown in FIGS. 2B and 2C are the same as those of FIGS. 1C and 1D, except that FIG. 2D shows the prestressed outer beam divided into two segments for easy handling and transportation. A compressive stress opposite to the stress produced by live and dead loads is introduced in the cast concrete on the lower flange of the left segment. A tensile stress is introduced on the concrete cast on the lower flange of the right segment.

Another possible method is to prestress only the positive moment area, and cast the concrete on the negative moment area after the beam is divided into segments. In this process, the right end of the beam need not be of a fixed end type.

Figure 3A:
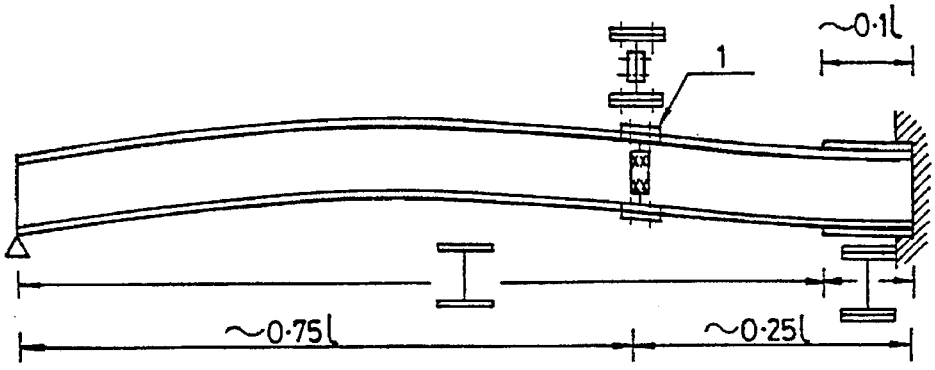
FIGS. 3A, 3B, 3C and 3D show a process for constructing segments of an outer span beam for connection with a slab made of precast concrete according to the present invention.
Figure 3B:
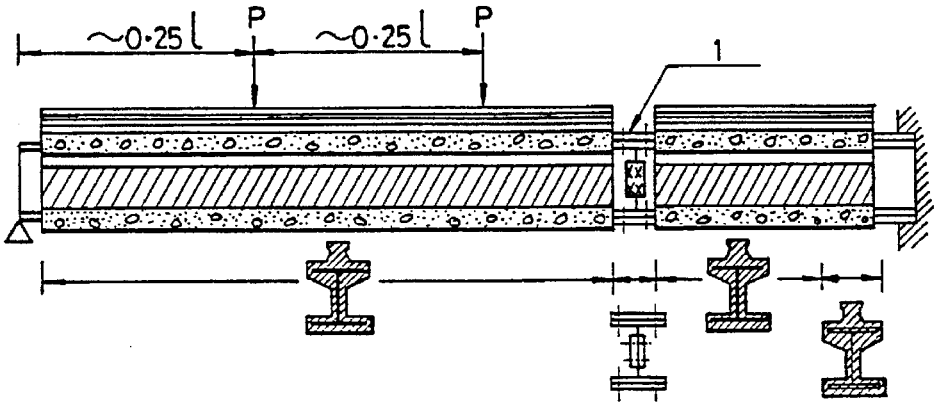
Figure 3C:
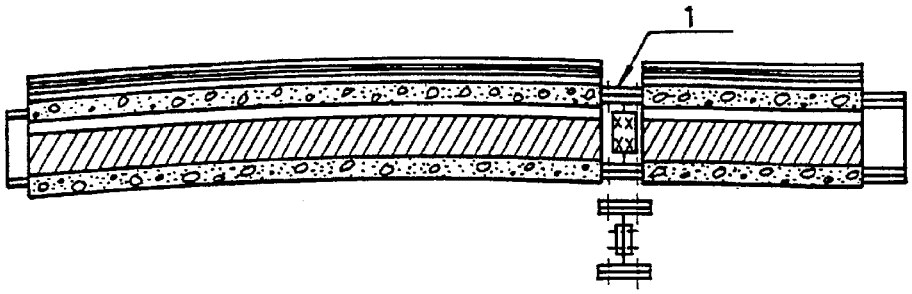
Figure 3D:
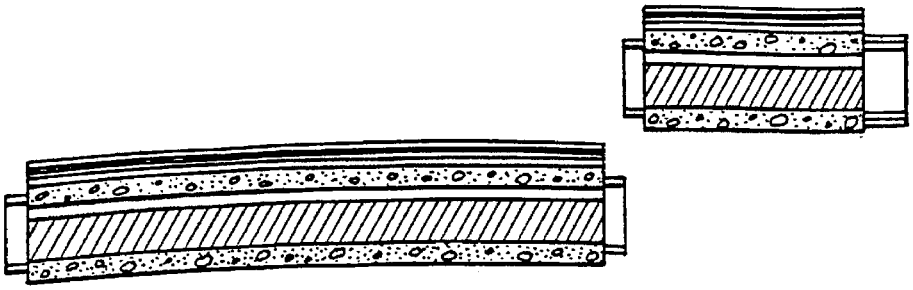

FIGS. 3A to 3D show the same steps for forming the outer prestressed beam of FIGS. 2A to 2D, except that a protrusion 3 having a shear key which is engagable with a precast slab is provided (refer to FIG. 12) and the entire steel I-beam is covered by concrete 2 except for the area of connection 1 and an area about 20 centimeters from both ends. FIG. 3A shows cover plates for reinforcing the connection between a beam and column in a continuous beam structure or an architectural structure. The upper and lower flanges are reinforced at their right ends by the cover plates which are about 10% of the beam length (l). FIG. 3D shows the beam divided into two segments for easy transportation and handling. A compressive stress opposite to the stress produced by live and dead loads is introduced in the concrete cast on the lower flange of the left segment. A tensile strain may be introduced in the concrete cast on the upper flange of the left segment. A compressive stress is introduced in the concrete cast on the upper flange of the right segment. A tensile strain may be introduced in the concrete cast on the lower flange of the right segment. FIGS. 4A to 4H show the construction steps for connecting two short outer prestressed beams to form a prestressed continuous beam structure according to the processes of FIGS. 1A to 1D or FIGS. 2A to 2D.

Figure 4A:
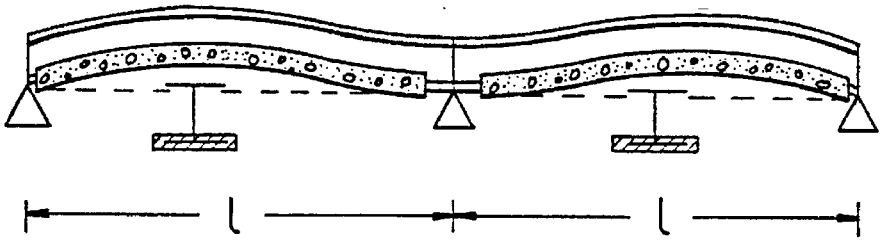
FIGS. 4A, 4B, 4C, 4D, 4E, 4F, 4G and 4H show a process for constructing a two span prestressed continuous beam structure according to the present invention.

FIG. 4A shows the steps for connecting two outer prestressed beams to form a continuous prestressed beam. The method includes the steps of: placing the prestressed beams in end to end relation; connecting the prestressed beams together at the connection point; deflecting the prestressed beams at the connection point within the limitation of elasticity of the prestressed beams; casting and curing concrete on the prestressed beams at the connection point; and lowering the prestressed beams at the connection point relative to the outer ends of the first and second prestressed beam whereby compressive stress is introduced to the concrete cast and cured on the prestressed beams at the connection point. The prestressed beams may be partially moved toward their deflected positions before they are connected together.

The method may be carried out by placing the prestressed beams on supports including a first end support disposed at the outer end of the first end prestressed beam, a second end support disposed at the outer end of the second end prestressed beam and an inner support disposed at the connection point. Another possible method is to unify the two beams on a partially lifted support. The connection should be made by bolting and welding methods generally used in steel beam structures. In this case, the connection is reinforced by a stiffener in order to obtain the necessary rigidness.

Figure 4B:
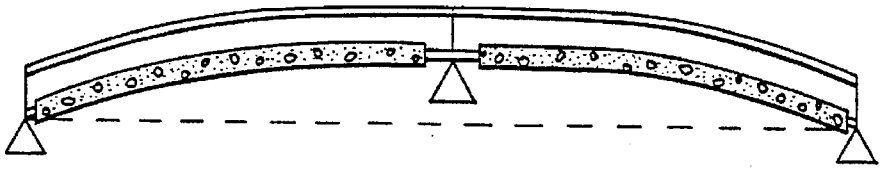
Figure 4C:
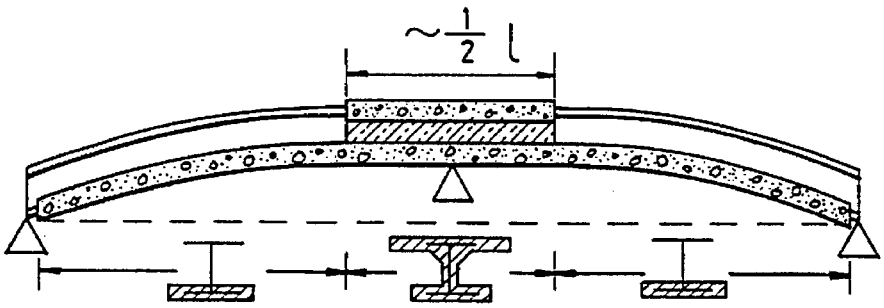
Figure 4D:
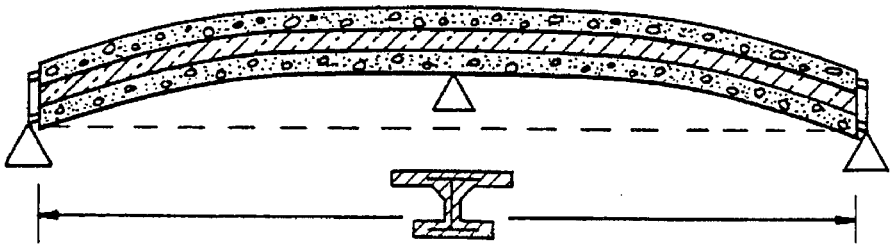
Figure 4E:
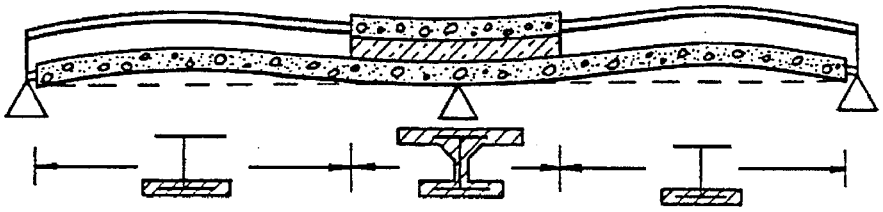

After the two prestressed beams are continuously unified and lifted on the support, the slab and web are cast by concrete on the negative moment area, that is, ¼ l from the central support (FIGS. 4B and 4C). As shown in FIG. 4C, the negative moment area is partially cast by concrete. FIG. 4D shows the prestressed continuous beam cast by concrete on the overall area of slab and web at the same time through the first and second beams. This method has a fault in that compressive stress is put on the slab in the positive moment area inside the beam, but it is acceptable in respect of rapid construction and structural continuity in cases where the influence of live loads is less than that of dead loads. In this process, the concrete on a diaphragm should be cast at the same time. The support would be lifted by a hydraulic jack.

Figure 4F:
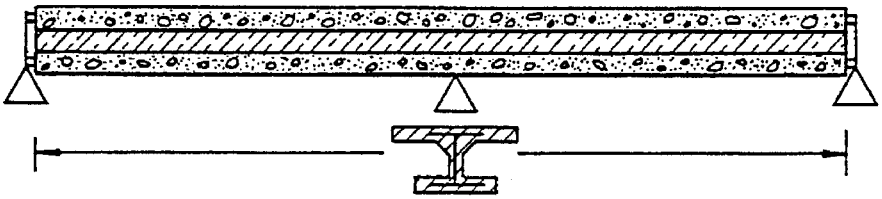
Figure 4G:
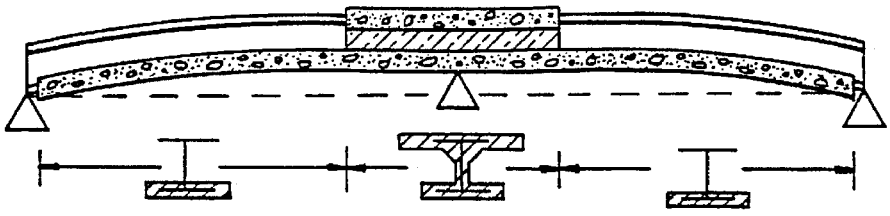
Figure 4H:
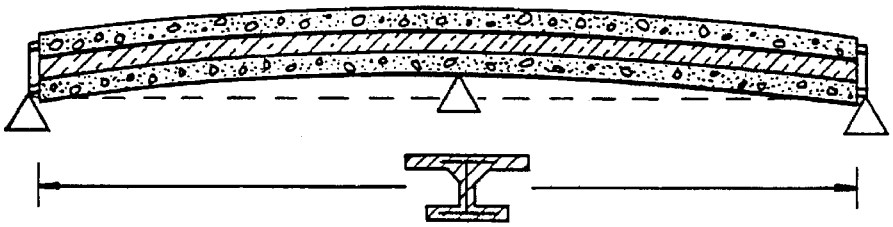

After the two prestressed beams have been completely unified by casting and curing concrete on the slab and web in the central connection area or the overall beam, the support is lowered (FIG. 4F). A compressive stress capable of cancelling the tensile stress produced by a negative moment is introduced in the concrete cast on the upper flange of the central support area in which negative moments are produced by dead and live loads. In the cases where concrete is cast on the slab and web of the positive moment area after the lifted support is partially lowered (FIG. 4G), or where concrete is simultaneously cast on the slab and web in the overall beam while the support is still lifted, the continuous prestressed beam structure may take on a curved profile with a convex central portion (FIG. 4H).

Through the above processes, the two beam prestressed beams are completely unified and prestressed compressive stresses are introduced throughout the overall beam which are capable of cancelling the considerable amount of tensile stresses due to the positive and negative moments caused by dead and live loads, so that the object of the invention can be achieved.

FIG. 4F shows concrete cast on the slab and web throughout the continuous beam while the prestressed beam is in a horizontal state. If the lifted support is partially lowered, the continuous prestressed beam structure may take on an attractive appearance and, in the case of a bridge, it may be a beam type arch bridge with a high bridge space (refer to FIG. 4H).

Figure 8:
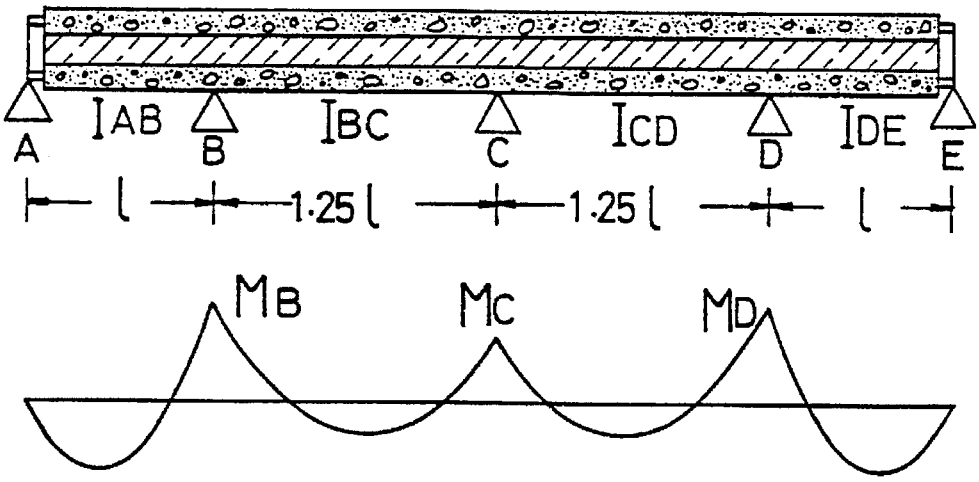
FIG. 8 shows a four span continuous beam and its moment diagram.

FIG. 8 shows the system of a four beam prestressed continuous beam structure and the diagram of a bending moment by dead loads. The inner prestressed beam length can be 25% longer than the outer prestressed beam because under dead loads, the moment in the central area of the inner beam is considerably reduced. In a three or more beam continuous beam structure, the process for manufacturing the first and the last beam, that is, the outer beams, is the same as that of a two beam continuous beam structure (refer to FIGS. 1A to 1D), but the process for producing inner beam beams in which negative moments are produced at both ends is different from the process of FIGS. 1A to 1D.

FIGS. 5A to 5D show the process for manufacturing the inner beam of a three or more beam prestressed continuous beam. Both ends are fixed and the beam has an upwardly curved central portion corresponding to the positive moment produced in the inner beam by dead and live loads. The curve pattern would be obtained by applying loads in the direction opposite to that of the loads shown in FIG. 5B.

The three degree parabolic expression for the curve of a steel I-beam with both ends fixed is as below.

$x \leqq 0.625\ l$:

$$y(x) = \frac{\sigma_{all} \bullet \omega}{Ell} (-0.531x^3 + 0.5x^2 l)$$

$x \geqq 0.625\ l$:

$$y(x) = \frac{\sigma_{all} \bullet \omega}{Ell} (0.5333x^3 - 1.5lx^2 + 1.25l^2x - 0.26l^3)$$

The curve expressed by these equations is induced by applying the concentrated load to the midpoint of the beam, but the precise form of the curve will vary somewhat depending on the magnitude of dead loads and live loads or the number of beams.

The symbols for the above expression have the same meanings as those of the beam curve in FIG. 1A described above.

Figure 5A:
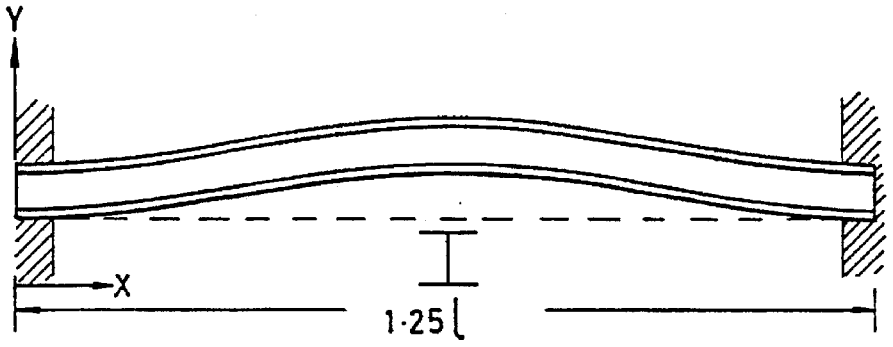
FIGS. 5A, 5B, 5C and 5D show a process for constructing an inner prestressed beam for connection with a slab made of cast-in place concrete according to the present invention.
Figure 5B:
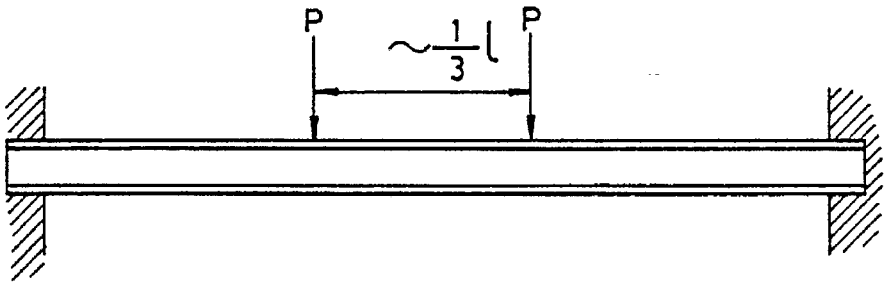
Figure 5C:
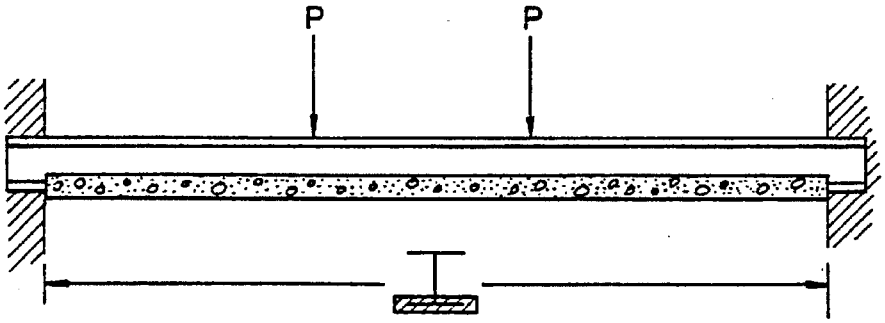
Figure 5D:
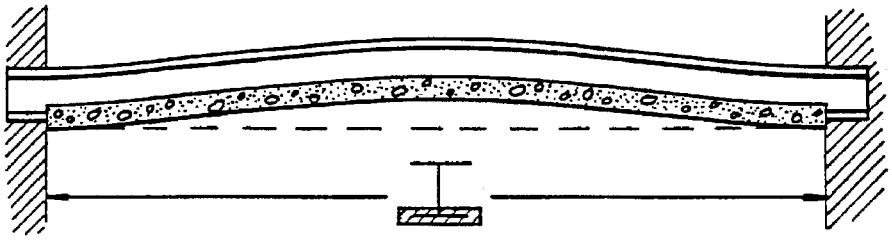

FIG. 5B shows two concentrated loads P applied within the limitation of elasticity. The two loads are preferably positioned ⅙ l from the mid point of the beam. The concrete is cast and cured by two concentrated loads on the lower flange of the steel I-beam which is in a horizontal state (FIG. 5C). In this process, concrete may be cast only on the positive moment area, and concrete may be cast on the negative moment area after loads P have been removed. In addition, instead of having both ends fixed, supports may be provided at the point in which the moment by dead loads is about zero to introduce prestressed compressive stress only on the lower flange of the positive moment area of the steel I-beam. After the loads P are removed and the concrete is cured, compressive stress is introduced to the positive moment area and tensile strain may be introduced to the negative moment area (FIG. 5D).

Figure 6A:
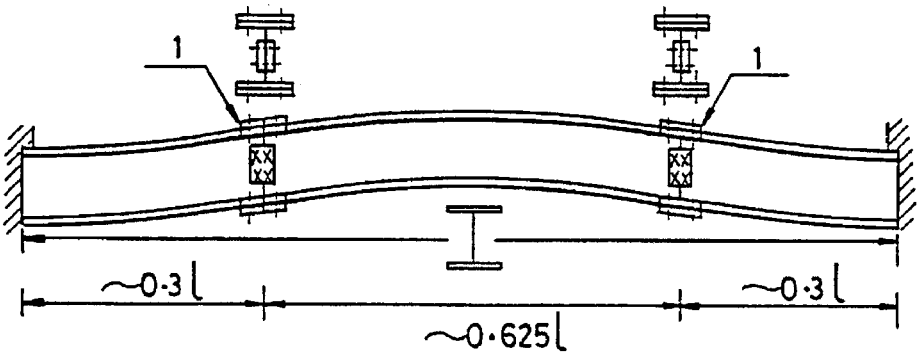
FIGS. 6A, 6B, 6C and 6D show a process for constructing segments of an inner span beam for connection with a slab made of cast-in place concrete according to the present invention.
Figure 6B:
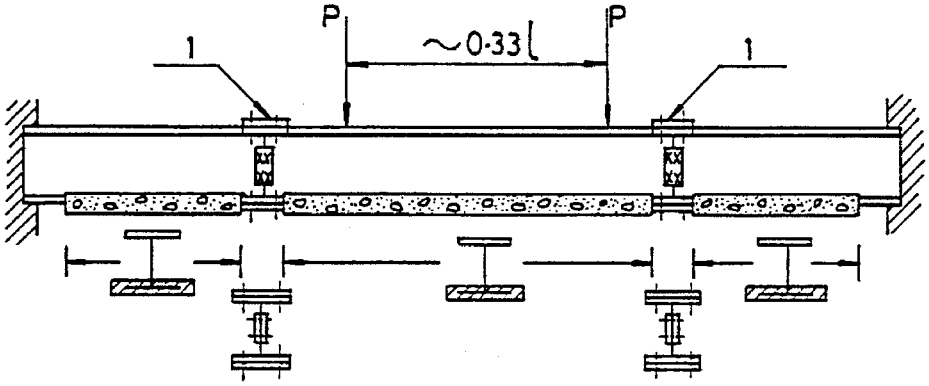
Figure 6C:
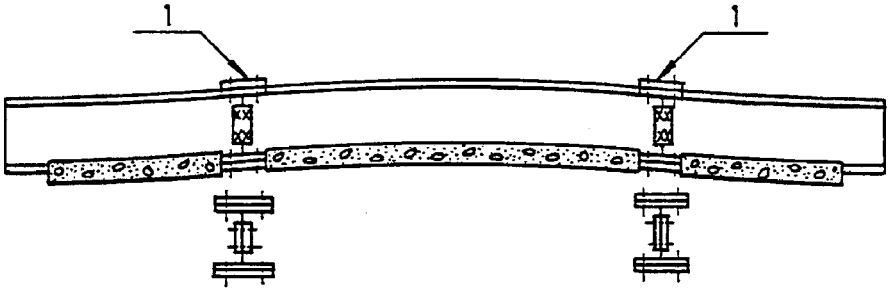

The steps shown in FIGS. 6A to 6C are the same as that in FIGS. 5A to 5D but, for easy transportation and handling, connections 1 are provided at 0.3 l (about ¼ of overall beam length (1.25 l)) from both ends, in which the moment by dead loads is approximately zero. In this process another possibility is to cast concrete only on the lower flange of the central segment so that the concrete is compressively prestressed. Concrete is cast on the lower flanges of the right and left segments after the beam has been divided to prevent tensile stress of the concrete. In this case, both ends can be treated so as not to be of the fixed type.

Figure 6D:
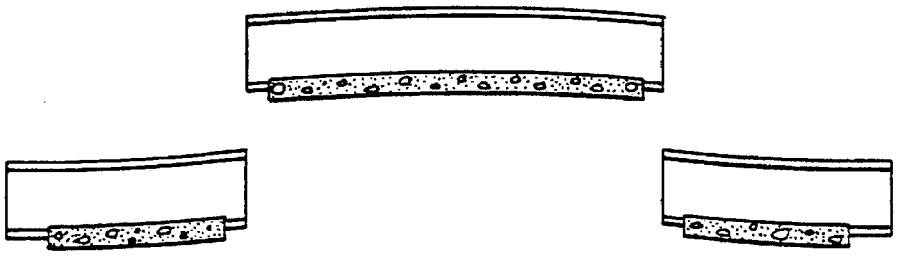

FIG. 6D shows the prestressed beam divided into three segments. A tensile strain is introduced to the concrete cast on the lower flange of both end segments if its stress is not zero. Compressive stress opposite to the stresses due to dead and live loads is introduced to the concrete cast on the lower flange of the central segment.

FIGS. 7A to 7D show a segmented beam process for manufacturing the inner beam prestressed beam in the same structure as that of FIGS. 6A to 6D, but a protrusion 3 having a shear key engagable with a precast slab 6 is provided, and the overall steel I-beam is covered with concrete 2 except for the connection 1 area and the areas about 20 cm from both ends.

Figure 7A:
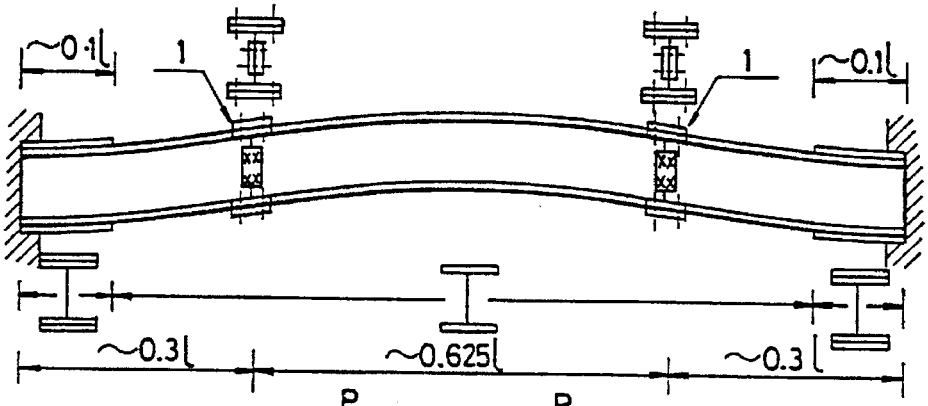
FIGS. 7A, 7B, 7C and 7D show a process for constructing segments of an inner span beam or a precast slab connecting two columns.
Figure 7B:
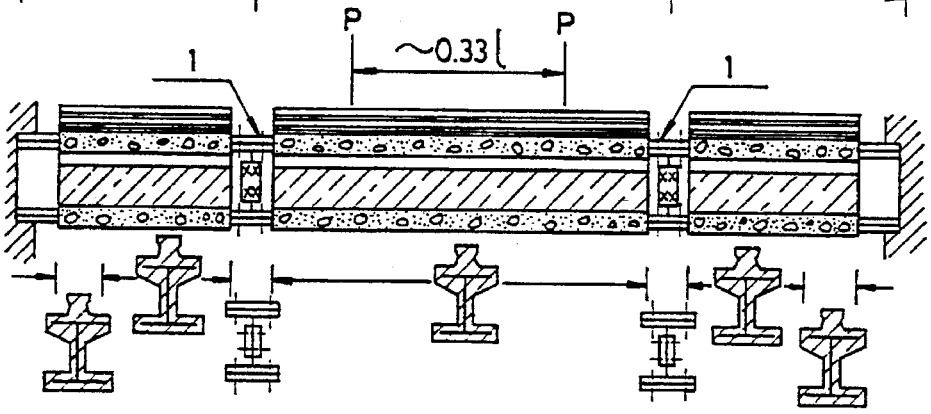
Figure 7C:
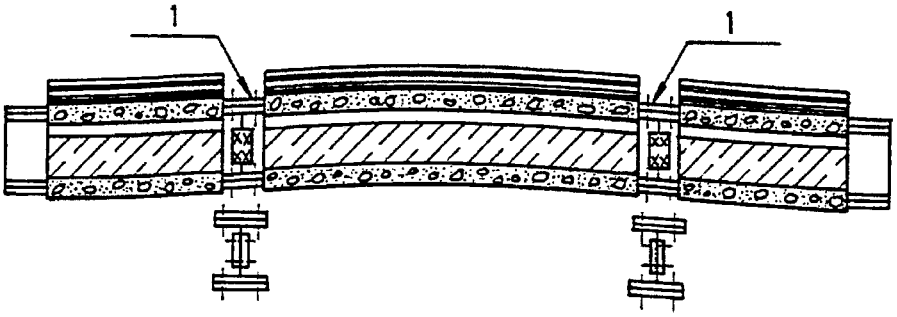
Figure 7D:
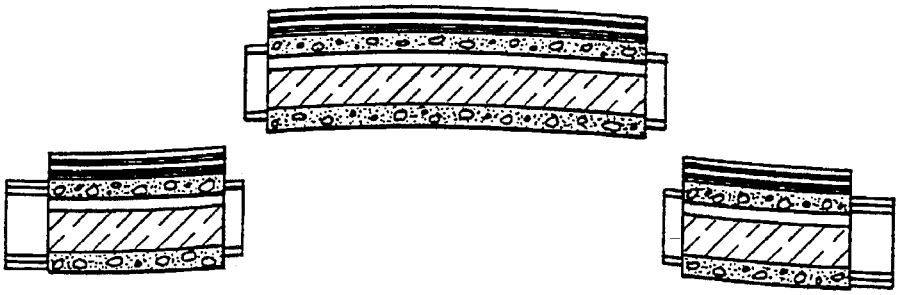

In order to reinforce the connection between the beam and the column in a continuous beam structure or an architectural structure, the upper and lower flanges should be reinforced at both ends by cover plates which are about 10% of the beam length (l) (FIG. 7A). An alternative is to introduce only compressive stress to the concrete while the segments are connected, and to cast the concrete on the tensile stress area after the beam has been divided. In this case, both ends can also be treated so as not to be of the fixed type.

Figure 9A:
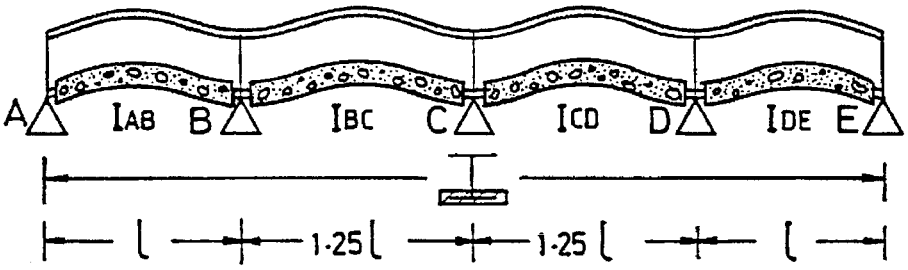
FIGS. 9A, 9B, 9C, 9D and 9E show a process for constructing a four span prestressed continuous beam structure by means of a partial concrete casting according to the present invention.
Figure 9B:
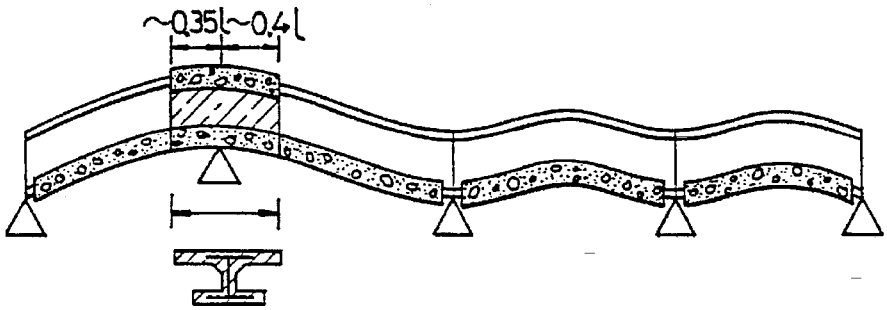
Figure 9C:
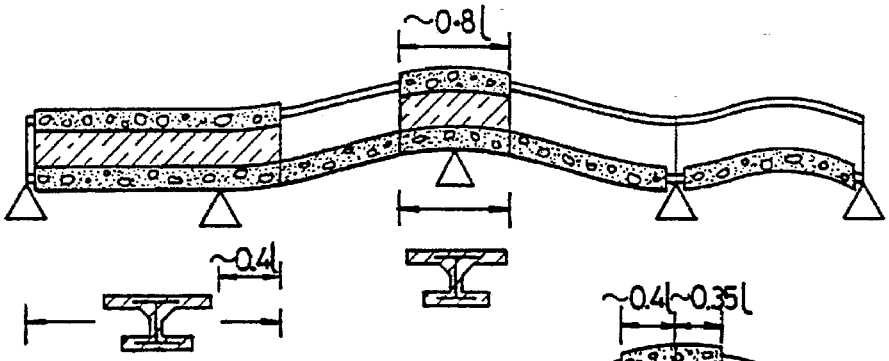
Figure 9D:
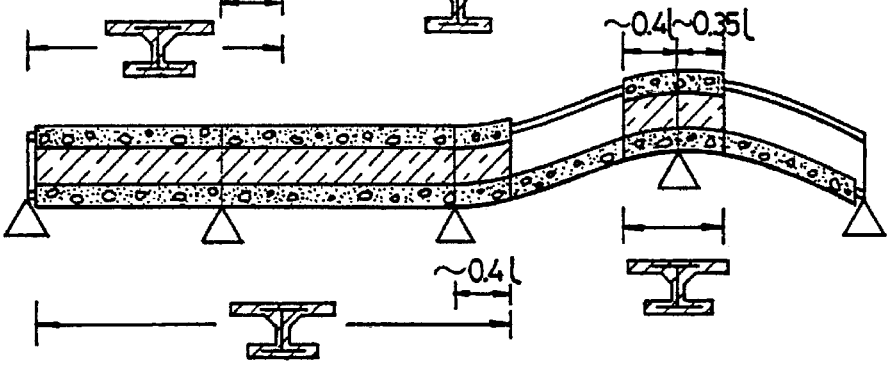
Figure 9E:
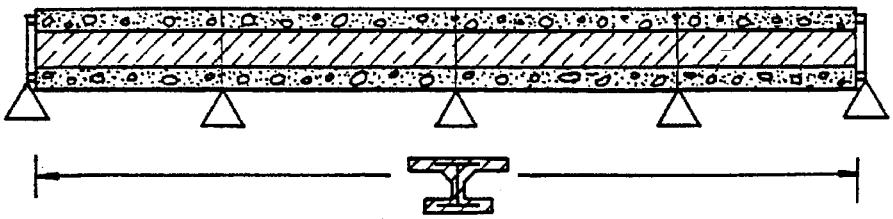

The construction process for a four beam prestressed continuous beam structure will now be described with reference to FIGS. 9A to 9E and FIGS. 10A to 10E. The outer prestressed beam $I_{AB}$ (FIG. 1D) and the inner prestressed beam $I_{BC}$ (FIG. 5D) are unified on support B, and the support B is lifted to deflect the beams within the limitation of elasticity. The two beams may also be unified after the support is partially lifted. The next step involves two alternative methods. The first is shown in FIGS. 9A to 9E. Concrete is first cast and cured on the slab, web and diaphragm in the negative moment area on the left side and the right side 0.35 l and 0.4 l respectively from support B (FIGS. 9B, 9C and 9D), and support B is completely or partially returned. By doing so, the compressive stress is introduced to the slab of negative moment area around support B. The next step is to cast the concrete on the slab, web and diaphragm in the positive moment area of the outer beam $I_{AB}$. Similar steps may be applied to supports C, D . . . to complete the prestressed continuous beam structure (FIG. 9D).

Figure 10A:
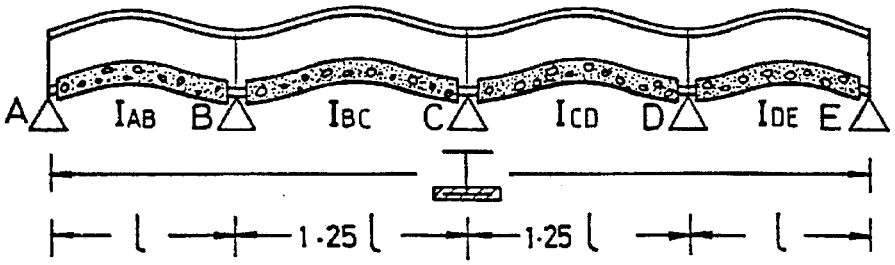
FIGS. 10A, 10B, 10C, 10D and 10E show a process for constructing a four span prestressed continuous beam structure by means of an overall concrete casting according to the present invention.
Figure 10B:
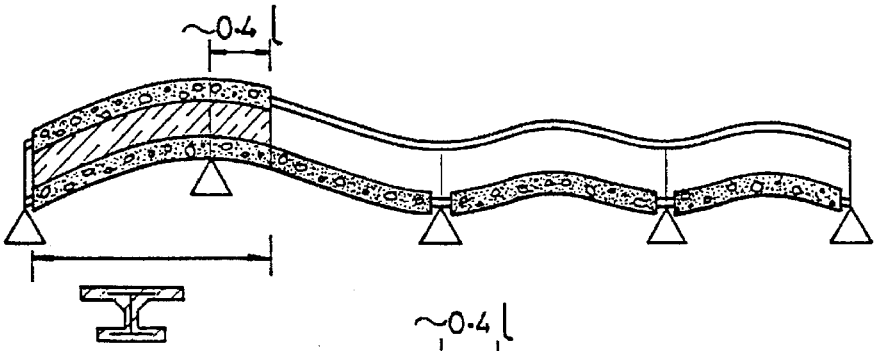
Figure 10C:
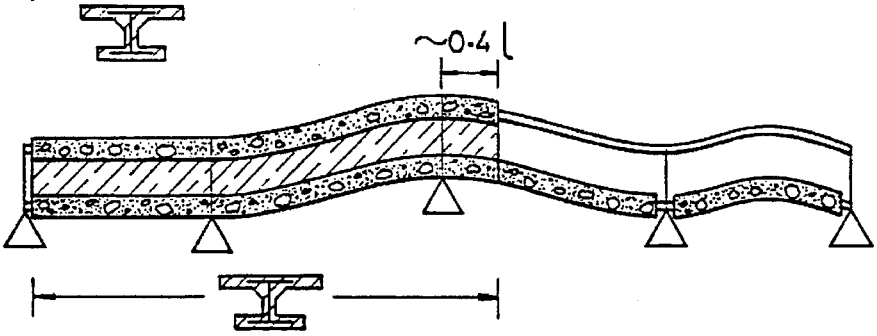
Figure 10D:
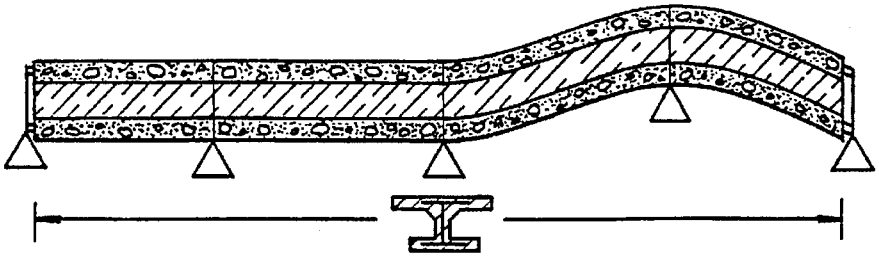
Figure 10E:
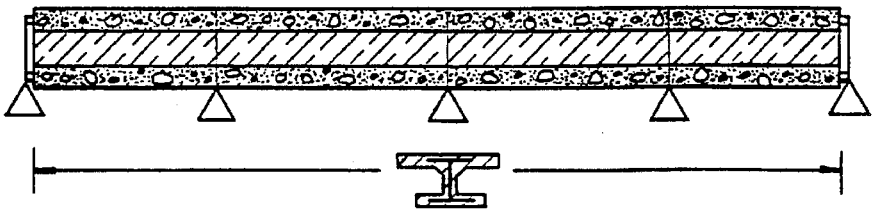
Figure 11A:
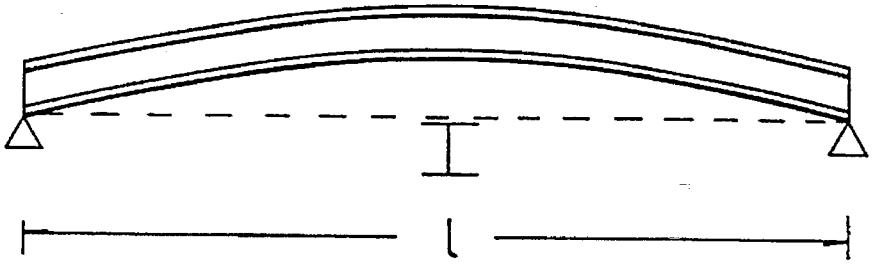
FIG 11A PRIOR ART
FIGS. 11A, 11B, 11C and 11D show a prior art process for constructing a conventional prestressed beam.
Figure 11B:
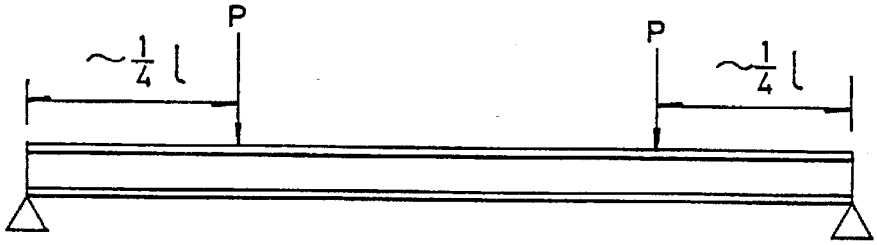
FIG 11B PRIOR ART
Figure 11C:
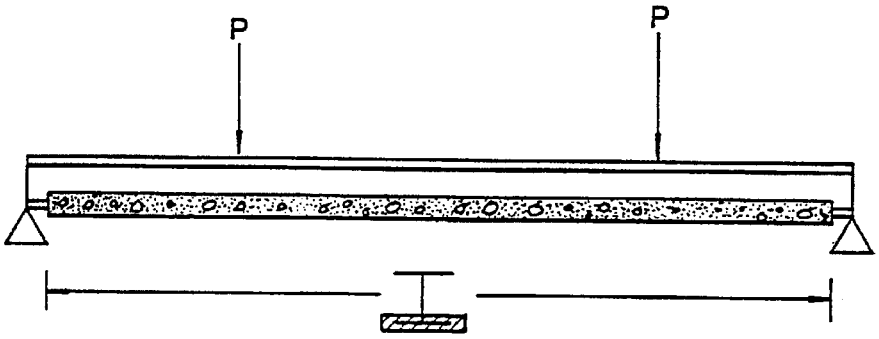
FIG 11C PRIOR ART
Figure 11D:
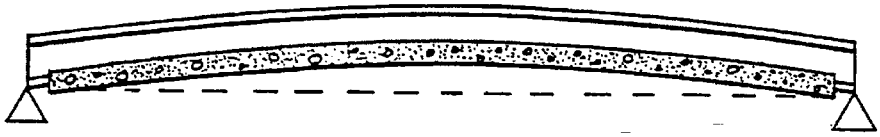
FIG 11D PRIOR ART

The second method is shown in FIGS. 10A to 10E. After lifting support B first and second beams $I_{AB}$, $I_{BC}$ within the limitation of elasticity, concrete is cast and cured over the slab, web and diaphragm of the first beam and to a location 0.4 l to the right of support B, and support B is completely or partially returned. As a result, compressive stress is introduced to the slab in negative moment area around support B. Next, the third beam $I_{CD}$ and the second beam $I_{BC}$ are lifted from the horizontal or partially lifted state to a fully deflected position. Concrete is cast and cured over the uncovered portion of the slab, web and diaphragm of the second beam and onto the third beam to a location about 0.4 l to the right of support C (FIG. 10C). The last step for completing support D is similar to the previous process. In this step, concrete is cast on the slab, web and diaphragm of the third and the fourth beam at the same time to complete the four beam prestressed continuous beam structure (FIG. 10E). The above mentioned second method is acceptable in respect of rapid construction and structural continuity in the case that the influence of live loads is less than that of dead loads. The continuous beam structure of more than four beams may be constructed according to either one of methods described above.

Figure 12:
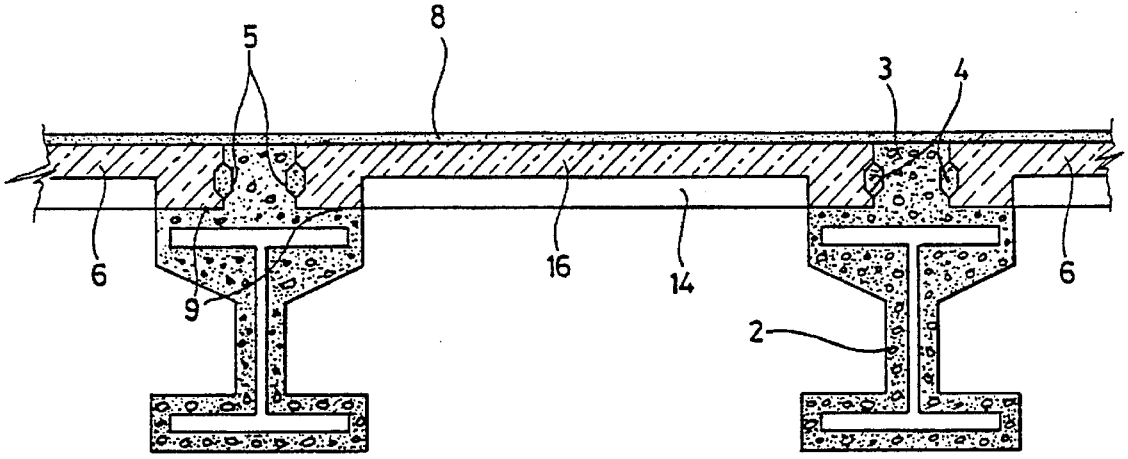
FIG. 12 cross-section view showing a connection between a precast slab and a prestressed beam for a precast slab according to the present invention.

FIG. 12 is a sectional view showing a prestressed beam of FIGS. 3A to 3D, and FIGS. 7A to 7D fabricated with a precast slab 6. The slab 6 is placed on a bearing bracket 9, and a shear key 34 is made by grouting the mortar in a shear key groove 5, so that the slab and the beam are unified and vertical displacement between them is prevented. The shear keys are installed at intervals along the longitudinal direction of the beam against horizontally external force such as braking force due to travelling vehicles, to prevent the horizontal displacement between the prestressed beam and the precast slab.

As shown in FIG. 12, after the beam and slab are unified, the surface of the slab is finished with water-proof mortar 8, asphalt or the like.

Figure 13:
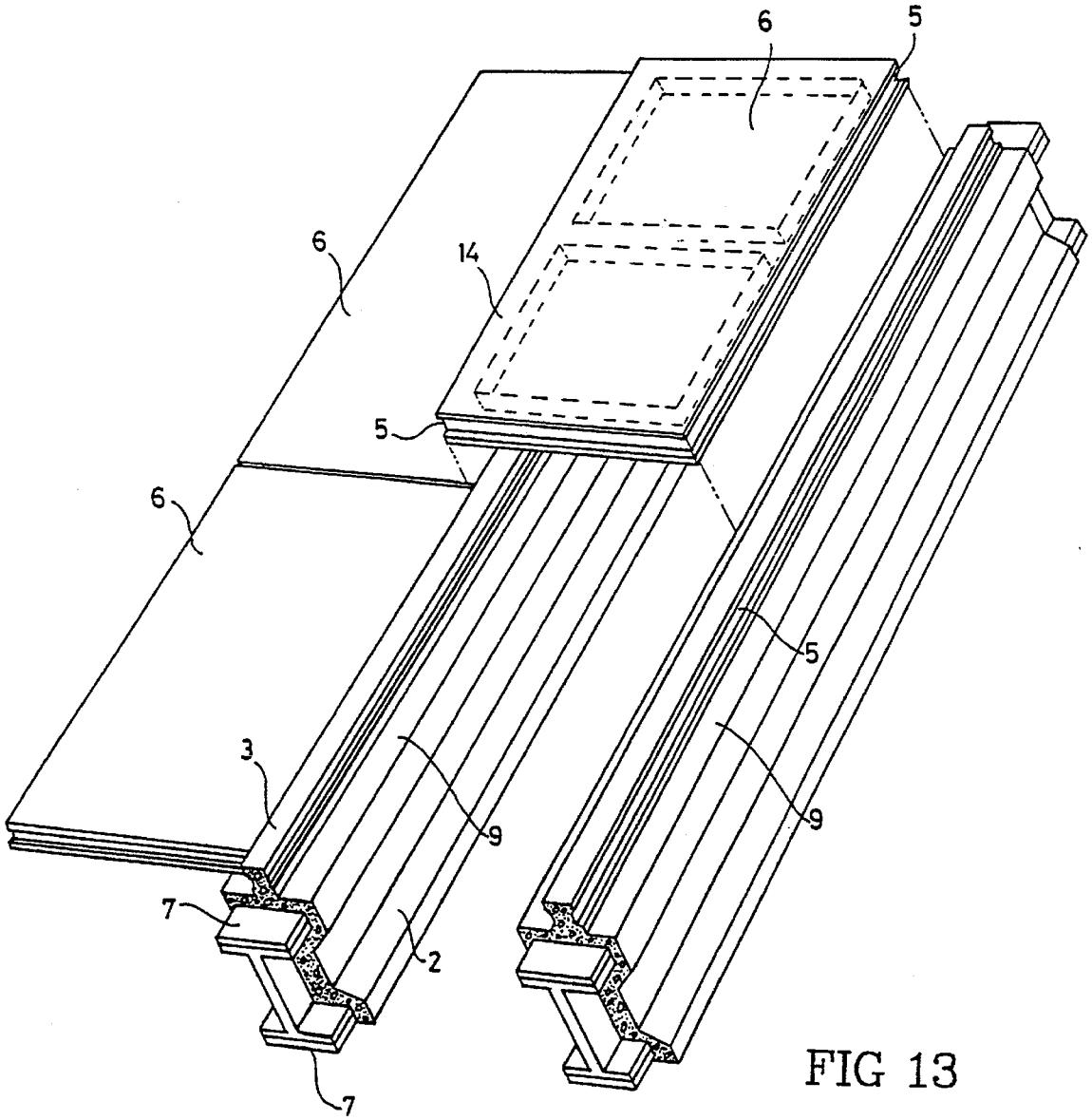
FIG. 13 is a perspective view showing a connection between the precast slab and the prestressed beam for a precast slab according to the present invention.

FIG. 13 illustrates fabrication of the prestressed beams with the precast slab 6 according to the invention. The precast slab is provided with shear key grooves 5 along its side, and reinforcing beams 14 along its periphery and the longitudinally central area. The shear keys made by grouting mortar in the shear key grooves provided laterally at both ends of the precast slab unify the slabs at the slab connecting portions to prevent vertical movement or displacement.

Figure 14:
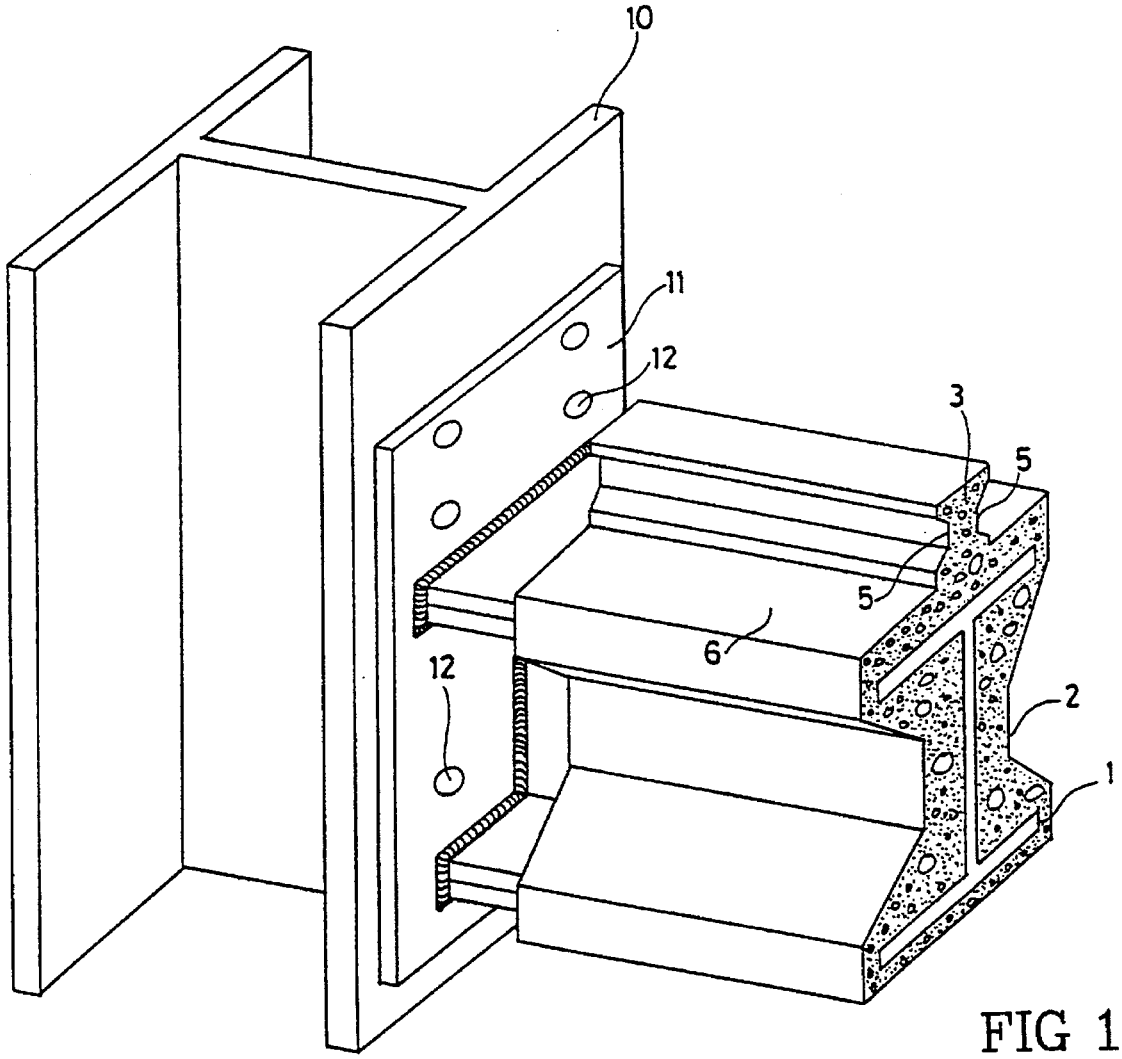
FIG. 14 shows a connection between a column and the beam according to the present invention.

FIG. 14 shows, as an embodiment applicable to a high-rise building, the connection between an H-beam and the prestressed beam. A reinforcing plate 11 is welded to the end of the beam for the mortar connection with the column. After the column and the prestressed beams have been connected according to the invention as shown in FIG. 14, placing the precast slab between the beams and grouting the mortar in the shear key grooves makes it possible to eliminate tasks such as form work, slab concrete casting, and covering the beam with concrete. The gap between the column and the beam is finished during the step of covering the column with concrete.

I claim:

1. A method for connecting prestressed beams having lower flanges cast with compressively prestressed concrete to construct a prestressed continuous beam having a moment equal to zero at both ends thereof and negative moments at at least one connection point of said prestressed beams, the method comprising the steps of:

placing the prestressed beams in end to end relation thereby forming a row of prestressed beams including a first end prestressed beam at one end of the row and a second end prestressed beam at an opposite end of the row; said first and second end prestressed beams each having an outer end which is not adjacent to an end of any other prestressed beam in the row, adjacent ends of the prestressed beams in the row defining said at least one connection point;

connecting the prestressed beams together at said connection point;

deflecting the prestressed beams at said connection point within the limitation of elasticity of the prestressed beams;

casting and curing concrete on the prestressed beams at said connection point to a deflected position; and at least partially returning the prestressed beams at said connection point from the deflected position whereby compressive stress is introduced to the concrete cast and cured on the prestressed beams at said connection point.

2. A method as set forth in claim 1 wherein the step of casting and curing concrete comprises the step of casting and curing slab concrete on upper flanges of the prestressed beams at said connection point only in the negative moment areas of the prestressed beams at said connection point.

3. A method as set forth in claim 2 wherein the step of casting and curing further comprises the steps of casting web concrete and diaphragm concrete of the prestressed beams only in the negative moment areas of the prestressed beams at said connection point.

4. A method as set forth in claim 3 wherein the row of prestressed beams is disposed on supports including a first end support disposed at the outer end of said first end prestressed beam, a second end support disposed at the outer end of said second end prestressed beam and an inner support disposed at said connection point, the step of deflecting the prestressed beams comprising the step of raising the inner support.

5. A method as set forth in claim 4 wherein the step of casting and curing concrete on the prestressed beams further comprises, following said step of casting slab concrete, web concrete and diaphragm concrete only on negative moment areas of the prestressed beams, the step of casting slab concrete, web concrete and diaphragm concrete on a positive moment area of at least one of the prestressed beams connected together at said connection point.

6. A method as set forth in claim 5 wherein there are a plurality of connection points between said first and second end prestressed beams for connecting a plurality of prestressed beams, the method further comprising the step of repeating at least said steps of placing, deflecting, casting and curing, returning and casting for all of said connection points.

7. A method as set forth in claim 6 wherein said claimed steps are first performed at one of said connection points closest to said first end prestressed beam and repeated for all of said connection points progressing sequentially from said one connection point to another of said connection points next most proximate to said first end prestressed beam until a connection point nearest said second end prestressed beam is reached.

8. A method as set forth in claim 1 wherein said step of connecting comprises the steps, in order, of:

partially deflecting the prestressed beams at said connection point; and joining the ends of the prestressed beams defining said connection point.

9. A method as set forth in claim 1 wherein said step of casting and curing includes the step of casting and curing concrete on one of said prestressed beams from said connection point to a location no more than four tenths of the length of said one prestressed beam from said connection point.

10. A method as set forth in claim 1 wherein at least a selected one of said first and second end prestressed beams in the row of prestressed beams is made of a steel I-beam of length l having an upwardly extending curve therein with a peak point at a distance of about ⅜ l from one end of said selected one end prestressed beam, the shape of the curve being expressed by the following equations, $x \leqq 0.3\ l$:

-continued $$y(x)=\frac{\sigma_{all}\bullet\omega}{EIl}(-0.581x^3+0.228xl^2)$$

$x \geqq 0.3\ l$:

$$y(x)=\frac{\sigma_{all}\bullet\omega}{EIl}(0.454x^3-0.936lx^2+0.51l^2x-0.028l^3)$$

where x: arbitrary distance from the left end of the steel I-beam.

y: upward displacement of any point x from the left end of the steel I-beam.

l: length of the outer span steel I-beam of the prestressed composite continuous beam structure.

$\sigma_{all}$: allowable stress of the steel beam which is about 80 to 90% of yield stress $\sigma_\gamma$ E: elastic coefficient of 21,000 KN/cm$^3$ I: moment of inertia of cross section for steel I-beam ω: modulus of section for steel I-beam.

11. A method as set forth in claim 1 wherein said first and second end prestressed beams each have a length l, and wherein an inner prestressed beam in the row of prestressed beams located intermediate said first and second end prestressed beams is formed from an I-beam having a length of 1.25(l), said inner prestressed beam having an upwardly curved shape generally symmetrical about a midpoint of said inner prestressed beam, the shape of the curve being expressed by the following equations, $x \leqq 0.625\ l$:

$$y(x)=\frac{\sigma_{all}\bullet\omega}{EIl}(-0.531x^3+0.5x^2l)$$

$x \geqq 0.625\ l$:

$$y(x)=\frac{\sigma_{all}\bullet\omega}{EIl}(0.5333x^3-1.5lx^2+1.25l^2x-0.26l^3)$$

where x: arbitrary distance from the left end of the steel I-beam.

y: upward displacement of any point x from the left end of the steel I-beam.

l: length of the outer span steel I-beam of the prestressed composite continuous beam structure.

$\sigma_{all}$: allowable stress of the steel beam which is about 80 to 90% of yield stress $\sigma_\gamma$ E: elastic coefficient of 21,000 KN/cm$^3$ I: moment of inertia of cross section for steel I-beam ω: modulus of section for steel I-beam.

12. A method as set forth in claim 1 wherein at least one of the prestressed beams in the row of prestressed beams is a segmented prestressed beam, said segmented prestressed beam being formed in two separate segments to facilitate transportation and handling, the two segments being joined together to form said segmented prestressed beam.

13. A method as set forth in claim 12 wherein the segments are connected together at a location in said segmented prestressed beam where the bending moment caused by dead loads is approximately zero.

14. A method as set forth in claim 13 wherein said segmented prestressed beam is one of said first and second end prestressed beams, the segments of said segmented prestressed beam being joined together at a location of about 0.75 times the length of said segmented prestressed beam from the outer end of said segmented prestressed beam.

15. A method as set forth in claim 13 wherein said segmented prestressed beam is an inner prestressed beam of the row of prestressed beams located intermediate said first and second end prestressed beams, and wherein said segmented prestressed beam is formed of three segments, each outer segment of the three segments being joined to an inner segment of the three segments at a location 0.3 times the length of one of said end prestressed beams from respective ends of said segmented prestressed beam.

16. A method as set forth in claim 1 further comprising the steps of extruding a concrete formation on at least one of said prestressed beams in the row of prestressed beams, the formation defining a shear key groove, and connecting said one prestressed beam to a precast slab having a shear key groove by grouting mortar into the shear key grooves of said one prestressed beam and the precast slab.

* * * * *